United States Patent [19]

Maier

[11] Patent Number: 5,075,948

[45] Date of Patent: Dec. 31, 1991

[54] MINIMUM CLEARANCE DOWEL PIN EXTRACTION TOOL

[76] Inventor: Danny L. Maier, R.R. #1, Box 305A, Warsaw, Ind. 46580

[21] Appl. No.: 564,353

[22] Filed: Aug. 8, 1990

[51] Int. Cl.[5] ..... B25B 13/50

[52] U.S. Cl. ..... 29/264

[58] Field of Search ..... 29/264, 254, 255, 275, 29/263

[56] References Cited

U.S. PATENT DOCUMENTS

| | | | |
|---|---|---|---|
| 1,458,076 | 6/1923 | Potts | 29/264 |
| 2,916,813 | 12/1959 | Belanger | 29/264 |
| 3,740,814 | 6/1973 | Marshall | 29/264 |

*Primary Examiner*—Robert C. Watson

*Attorney, Agent, or Firm*—Thomas J. Dodd

[57] ABSTRACT

A tool for removing a dowel pin from an accommodating bore. The tool includes a body and a screw which on rotation of the body travels longitudinally in a threaded through bore in the body. The screw is threadibly attached to the dowel pin to pull the dowel pin from its bore as the screw travels within the tool body.

3 Claims, 3 Drawing Sheets

MINIMUM CLEARANCE DOWEL PIN EXTRACTION TOOL

FIELD OF THE INVENTION

This invention relates to a dowel pin extraction tool and has specific relevance to an extraction tool requiring minimal clearance space.

BACKGROUND OF THE INVENTION

Dowel pins are typically used in mechanical art fields as locators or fasteners connecting two pieces of metal. The dowel pin is press fitted within aligned smooth bores formed in the metal pieces. The dowel pins include a threaded longitudinal bore. Currently to remove a dowel pin the tip of an extraction tool is threaded into the pin's through bore and a slidable sleeve on the tool is violently and repeatedly slammed in a direction away from the pin to impart the tool handle. Repeated impact between the sleeve and handle causes the connected dowel pin to be jerked out of its accommodating bore. A problem exists however when the space between the exposed end of the dowel pin and an adjacent surface prevents the extraction tool from being connected to the dowel pin.

SUMMARY OF THE INVENTION

The minimum clearance dowel pin extraction tool of this invention eliminates the problems described above by relying on twisting screw force to pull the pin. Therefore, excessive clearance between the pin and adjacent structure is not required.

The extraction tool of this invention uses an internally threaded coupling rod having a hexagonal periphery for turning by a common wrench. A screw is carried within the coupling rod and includes a partially threaded through bore for accommodating a threaded shaft. One end of the threaded shaft is screwed into the dowel pin and the screw is turned down on the threaded shaft until it abuts the dowel pin. The coupling rod is then turned down to abut the area about the dowel pin. Continued turning of the coupling rod causes the screw shaft to travel upwardly within the coupling rod drawing the dowel pin out of its bore. An impact cap may be screwed onto the coupling rod to permit the rod to be struck by a hammer to break the dowel pin free if necessary while protecting the rod from marring.

Accordingly, it is an object of the invention to provide a novel dowel pin extraction tool.

Another object of this invention is to provide for a dowel pin extraction tool which uses screw force to pull a dowel pin from a bore.

Still another object of this invention is to provide an extraction tool which requires minimal space to operate.

Other objects of this invention will become apparent upon a reading of the following description taken with the accompanying drawings.

DESCRIPTION OF THE PREFERRED EMBODIMENT

Figure 1:
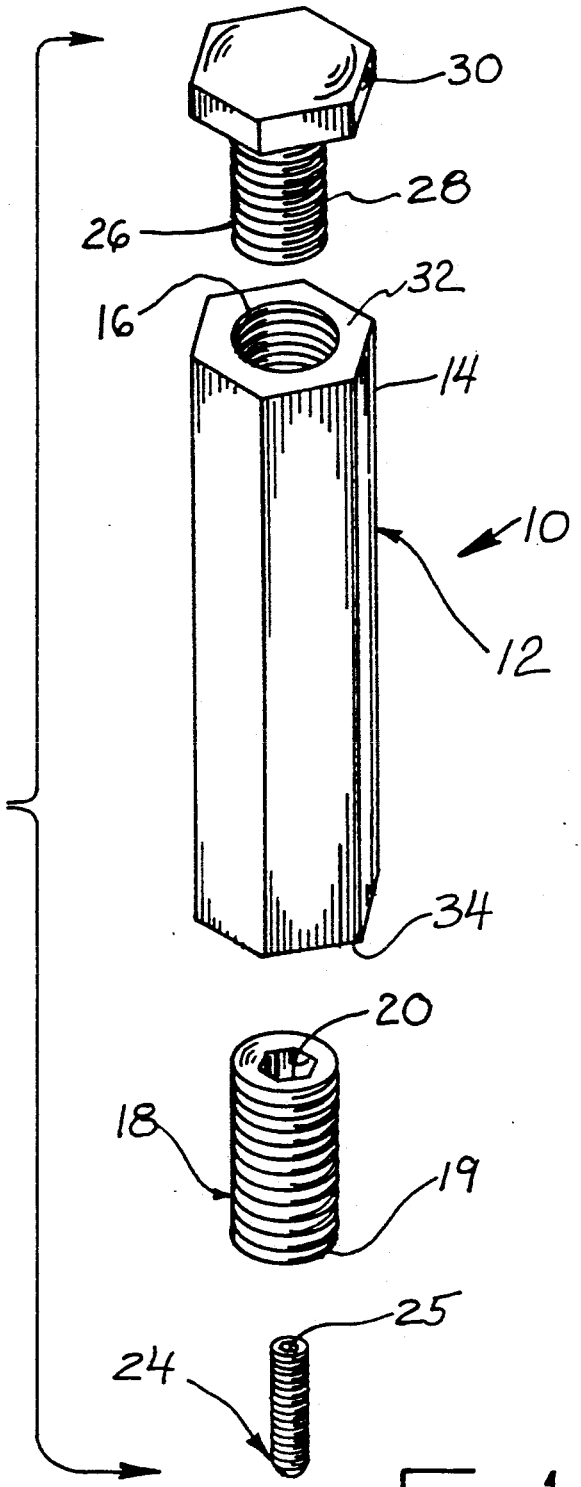
FIG. 1 is an exploded view of the extraction tool of this invention.
Figure 2:
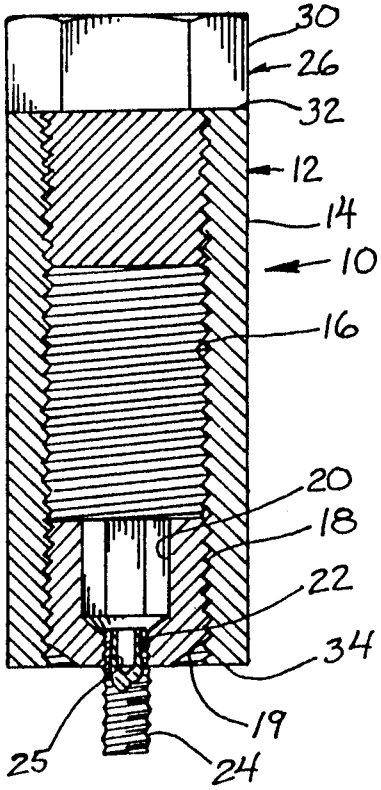
FIG. 2 is a longitudinal sectional view of the invention.
Figure 3:
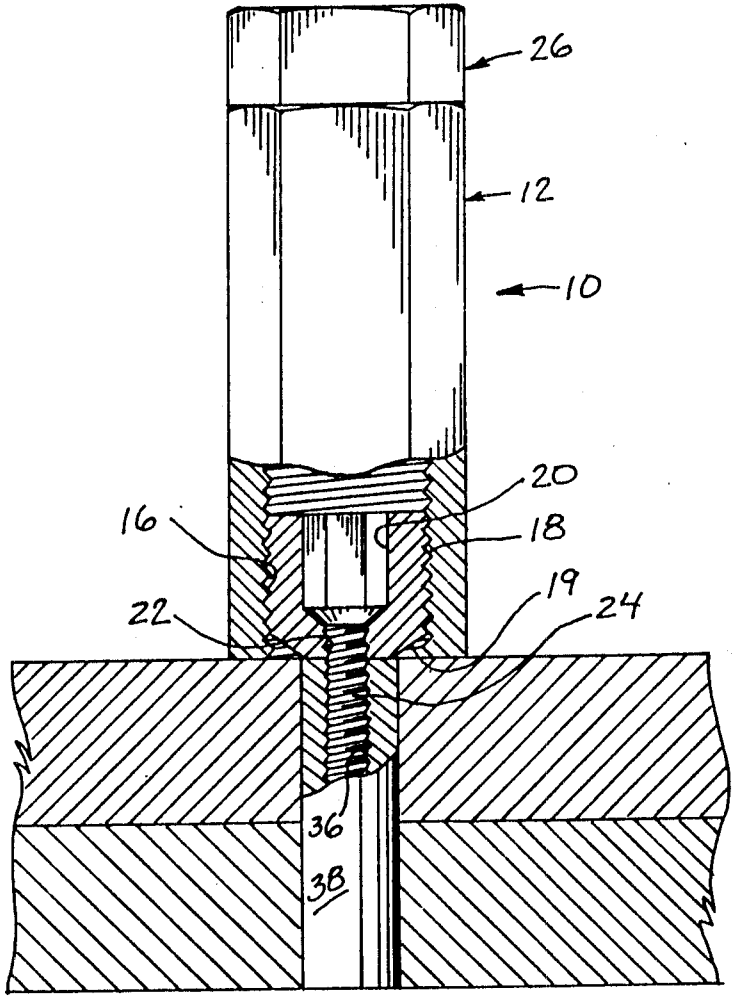
FIG. 3 is a longitudinal sectional view of the invention in use with a dowel pin.

The preferred embodiment herein described is not intended to be exhaustive or to limit the application to the precise form disclosed. Rather, it is chosen and described to enable others skilled in the art to utilize its teachings.

Referring now to the drawings extraction tool 10 includes a body 12 having a hexagonal outer wall 14 and a threaded longitudinal through bore 16. A screw 18 is provided and includes a hexagonal bore 20 in communication with a threaded bore 22. A small screw 24 is threaded a partial distance into screw 18 and extends longitudinally outwardly from bevelled end 19 of set screw 18 as illustrated. Small screw 24 includes a hexagonal blind bore 25. An impact cap 26 having a threaded shaft 28 and head 30 is turned into one end 32 of body 12 until head 30 abuts end 32 of the body.

Typically screw 18 is turned within body 12 such that end 19 of screw 18 and end 34 of body 12 are substantially flush. Screw 24 is screwed into bore 22 a partial distance and extends outwardly therefrom as shown in the figures.

In use, as a dowel pin extraction tool, the exposed end of screw 24 is screwed into threaded bore 36 of dowel pin 38 until end 19 of screw 18 and end 34 of body 12 abut the supporting surface 40 about the dowel pin. The user with the aid of a common wrench rotates body 12 so as to draw screws 18 and 24 upwardly into the body. Due to the interconnection of screw 18 and dowel pin 38 by screw 24, as screw 18 is drawn into body 12 pin 38 is pulled from its supporting structure. It should be understood that once connected to the dowel pin screws 18 and 24 remain rotationally stationary as body 12 turns. It is common that a dowel pin may be "frozen" within its supporting structure. Therefore, impact cap 26 is provided to provide a surface to be struck by a hammer to break the pin free after tension has been applied by rotating body 12. Therefore, it can be seen that the tool of this invention relying on screw force to remove the dowel pin requires minimal clearance between the supporting structure and an adjacent structure, not shown. If not required as an impact surface, impact cap 26 is not used and therefore screw 18 is permitted to travel the full length of body 12. The length and diameter of body 12 will be substantially dependent on the length and diameter of the pin. It is preferable that body 12 be long enough to fully extract the pin from its structure.

Figure 5:
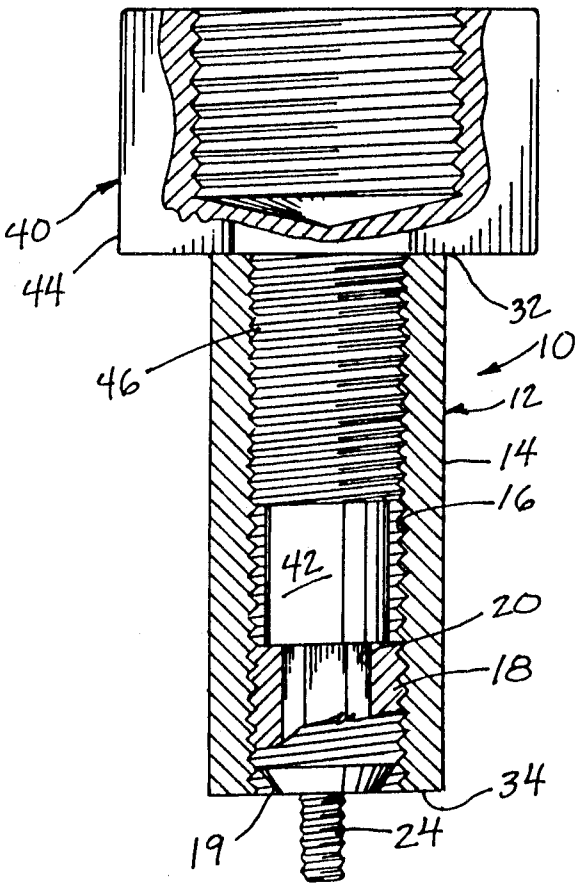
FIG. 5 is a longitudinal sectional view the invention with an adapter attached.
Figure 4:
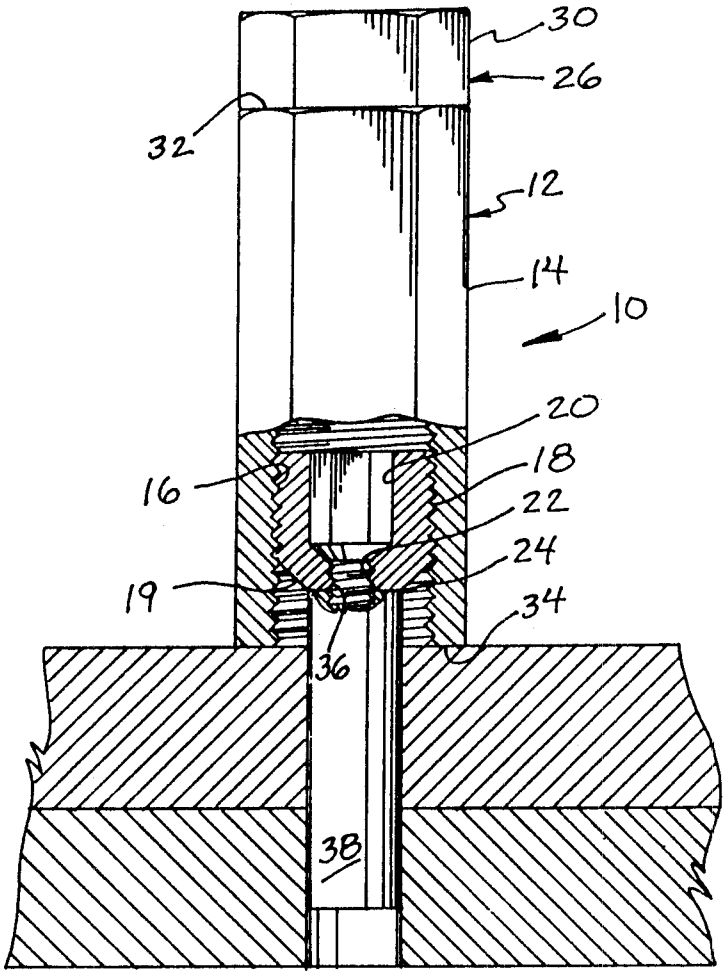
FIG. 4 is the longitudinal sectional view of FIG. 3 with the dowel pin partially extracted.

If desired, the extraction tool of the invention may be connected to a prior art slide hammer by replacing impact cap 26 with the adapter 40 shown in FIG. 5. As illustrated adapter 40 includes a shaft 42 extending from an internally threaded head 44. A portion 46 of shaft 42 is threaded to screw within bore 16 of body 12. Shaft 42 is of sufficient length to firmly seat against screw 18 when head 44 abuts end 32 of body 12. This arrangement provides use of a slide hammer instead of a regular hammer to provide force necessary to break the pin free.

If either screw 18 or 24 should break within body 12 or pin 38 removal of the screws may be accomplished by a common allen wrench.

It should be understood that the invention is not to be limited to the precise details above but may be modified within the scope of the appended claims.

I claim:

1. A tool for removing a dowel pin from an accommodating bore within a supporting structure, said tool comprising a body having first and second longitudinal ends and a connecting threaded through bore, a first screw member carried by said body within said through bore and being rotationally shiftable between said first and second longitudinal ends of the body, said first screw including means for connecting said screw to a dowel pin, wherein said body being rotated so that said first end abuts a supporting surface about said bore, such that continued rotation of said body causes said first screw with said dowel pin attached to shift from said first body longitudinal end toward said second body longitudinal end, said tool further including an impact cap removably carried by said body at said second longitudinal end, said impact cap constituting means for providing a striking surface.

2. The tool of claim 1 wherein said connecting means includes a second screw carried by said first screw for accomodation within a threaded bore of said dowel pin.

3. The tool of claim 1 further including an adapter carried by said body having a threaded shaft accommodated within said through bore adjacent said second longitudinal end and a socket member, wherein the inner circumference of said socket is greater than the outer circumference of said shaft, said socket being laterally threaded.

* * * * *